US011603289B2

(12) United States Patent
Madera et al.

(10) Patent No.: US 11,603,289 B2
(45) Date of Patent: Mar. 14, 2023

(54) SUPPORTING DEVICE FOR A ROTARY PLATFORM IN AN ELEVATOR SYSTEM

(71) Applicant: TK Elevator Innovation and Operations GmbH, Duesseldorf (DE)

(72) Inventors: Martin Madera, Neuhausen (DE); Martin Krieg, Neuhausen (DE)

(73) Assignee: TK Elevator Innovation and Operations GmbH, Duesseldorf (DE)

( * ) Notice: Subject to any disclaimer, the term of this patent is extended or adjusted under 35 U.S.C. 154(b) by 14 days.

(21) Appl. No.: 16/623,836

(22) PCT Filed: Jun. 19, 2018

(86) PCT No.: PCT/EP2018/066189
§ 371 (c)(1),
(2) Date: Dec. 18, 2019

(87) PCT Pub. No.: WO2018/234273
PCT Pub. Date: Dec. 27, 2018

(65) Prior Publication Data

US 2020/0131001 A1 Apr. 30, 2020

(30) Foreign Application Priority Data

Jun. 21, 2017 (DE) ..... 10 2017 005 850.4

(51) Int. Cl.
*B66B 9/00* (2006.01)
*B66B 7/02* (2006.01)

(52) U.S. Cl.
CPC ..... *B66B 9/003* (2013.01); *B66B 7/022* (2013.01); *B66B 7/024* (2013.01); *B66B 7/026* (2013.01)

(58) Field of Classification Search
CPC ..... B66B 7/02; B66B 7/022; B66B 7/023; B66B 7/024; B66B 7/026; B66B 7/027;
(Continued)

(56) References Cited

U.S. PATENT DOCUMENTS

2008/0078626 A1 4/2008 Kocher
2011/0042168 A1 2/2011 Grundmann
(Continued)

FOREIGN PATENT DOCUMENTS

CN 101152947 A 4/2008
CN 101875465 A 11/2010
(Continued)

OTHER PUBLICATIONS

English Translation of International Search Report issued in PCT/EP2018/066189, dated Oct. 4, 2018.
(Continued)

*Primary Examiner* — Minh Truong
(74) *Attorney, Agent, or Firm* — Dinsmore & Shohl LLP

(57) ABSTRACT

A support device for supporting a rotary platform of an elevator. The support device includes a first form-fit engagement means at an end of a fixed first guide rail, said end facing the platform, a third form-fit engagement means at an end of a third guide rail fastened to the platform and rotatable with the latter. In an alignment of the platform to a first position, the first and third form-fit engagement means are arranged with respect such that, when the platform deflects, as around an axis arranged in a second direction, the third form-fit engagement means is supported on the at least one first form-fit engagement means.

15 Claims, 5 Drawing Sheets

(58) Field of Classification Search
CPC ..... B66B 9/003; B66B 11/005; B66B 11/0085; B66B 11/0407
See application file for complete search history.

(56) References Cited

U.S. PATENT DOCUMENTS

| | | | | |
|---|---|---|---|---|
| 2017/0107080 | A1 | 4/2017 | Steinhauer | |
| 2018/0009633 | A1* | 1/2018 | Fargo | B66B 11/0407 |
| 2018/0257911 | A1 | 9/2018 | Gainche | |
| 2019/0077635 | A1* | 3/2019 | King | B66B 9/003 |
| 2019/0177125 | A1 | 6/2019 | Gainche | |
| 2020/0087113 | A1* | 3/2020 | Hakala | B66B 9/003 |

FOREIGN PATENT DOCUMENTS

| | | | |
|---|---|---|---|
| CN | 103130069 | A | 6/2013 |
| CN | 106115433 | A | 11/2016 |
| CN | 106163963 | A | 11/2016 |
| DE | 10 2015 218 025 | A | 3/2017 |
| DE | 10 2016 205 794.4 | A | 10/2017 |
| DE | 10 2016 211 997 | A | 1/2018 |
| EP | 2070860 | A1 | 6/2009 |
| JP | H04 191278 | A | 7/1992 |
| JP | H05 310384 | A | 11/1993 |
| JP | H09194169 | A | 7/1997 |
| JP | 2016121021 | A | 7/2016 |
| WO | 2013/139616 | A1 | 9/2013 |
| WO | 2015/144781 | A | 10/2015 |
| WO | 2017/010928 | A | 1/2017 |

OTHER PUBLICATIONS

First Office Action in foreign Chinese counterpart patent application No. 201880042118.7, dated Nov. 17, 2020.

Notice of Allowance, dated Jan. 6, 2022, in Chinese counterpart application No. CN 201880042118.7.

* cited by examiner

SUPPORTING DEVICE FOR A ROTARY PLATFORM IN AN ELEVATOR SYSTEM

CROSS REFERENCE TO RELATED APPLICATIONS

This application is a U.S. National Stage Entry of International Patent Application Ser. Number PCT/EP2018/066189, filed Jun. 19, 2018, which claims priority to German Patent Application No. DE 10 2017 005 850.4, filed Jun. 21, 2017, the entire contents of both of which are incorporated herein by reference.

FIELD

The present disclosure generally relates to a support device for supporting a platform of an elevator installation.

BACKGROUND

The invention applies to elevator installations with at least one elevator car, in particular a plurality of elevator cars, which can be moved in a shaft by means of guide rails. At least one fixed first guide rail is arranged fixedly in a shaft and is aligned in a first, in particular vertical direction; at least one fixed second guide rail is fixedly aligned in a second, in particular horizontal direction; at least one third guide rail rotatable with respect to the shaft is fastened to the mobile, here rotatable, platform and can be transferred with the latter between an alignment in the first direction and an alignment in the second direction. Such installations are described fundamentally in WO 2015/144781 A1 and also in German patent applications 10 2016 211 997.4 and 10 2015 218 025.5.

An elevator car of such elevator installations is fastened by a swivel joint to a chassis, which can be moved along the guide rails by means of guide rollers rolling along the guide rails. On account of the central suspension of the elevator car on the chassis and the long levers connected to the latter between the suspension and the guide rollers, high forces engage via the guide rollers close to the maximum turning circle radius of the swivel joint. Especially in the case of high loads, elastic deformations occur due to the distance of the guide rollers from the bearing centre and the high leverage forces associated therewith, which deformations can lead to a deflection of the platform and therefore to a misalignment on the guide rails and in particular between their guide surfaces.

Both the fixed guide rails running in the vertical and horizontal direction and also the suspension of the platform, which carries the rotatable third guide rail, are fastened in the elevator shaft. In the cross-over region at the junction of ends of the guide rails adjacent to one another, a certain distance between the guide rails is provided in each case in order to enable the rotation function of the platform. The elastic deformations to the guide rails and the platform or its suspension occurring in particular in the case of the high loads lead to a deflection of the platform or the guide rails arranged thereon and therefore to a misalignment between mutually adjoining guide rails, which adversely affects the travel comfort when the chassis crosses over and in addition leads to increased wear or in the extreme case to destruction of the rollers and brakes.

In order to avoid the aforementioned effects with the forces occurring in the normal travel operation, the platform, guide rails and the fastening thereof are designed sufficiently rigid. In cases of special loads, for example when the safety gear is deployed, high forces act on the guide rails due to the applied brake, which can lead to much more severe elastic deformations of the guide rails and of the platform or its suspension. Dynamic loads of the elevator car during motion, which are caused for example by slipping loads or by jerky movements of the passengers, can also lead to greater elastic deformations and therefore to misalignments between two guide rails adjoining one another, as a result of which equipment of a chassis crossing over the misalignment could be damaged and therefore the function of the chassis or even of the brake of the safety gear could be restricted.

In order to reduce such elastic deformations, the rigidity of the guide rails and their fastening, for example, can be increased by design changes. Possible measures are an increase in the installation space, an addition of material or changes to material, which is difficult with the underlying problem on account of design constraints.

Thus a need exists to create a device for an elevator installation which reduces the danger due to misalignments between the guide rails on account of elastic deformations.

DETAILED DESCRIPTION

Figure 1:
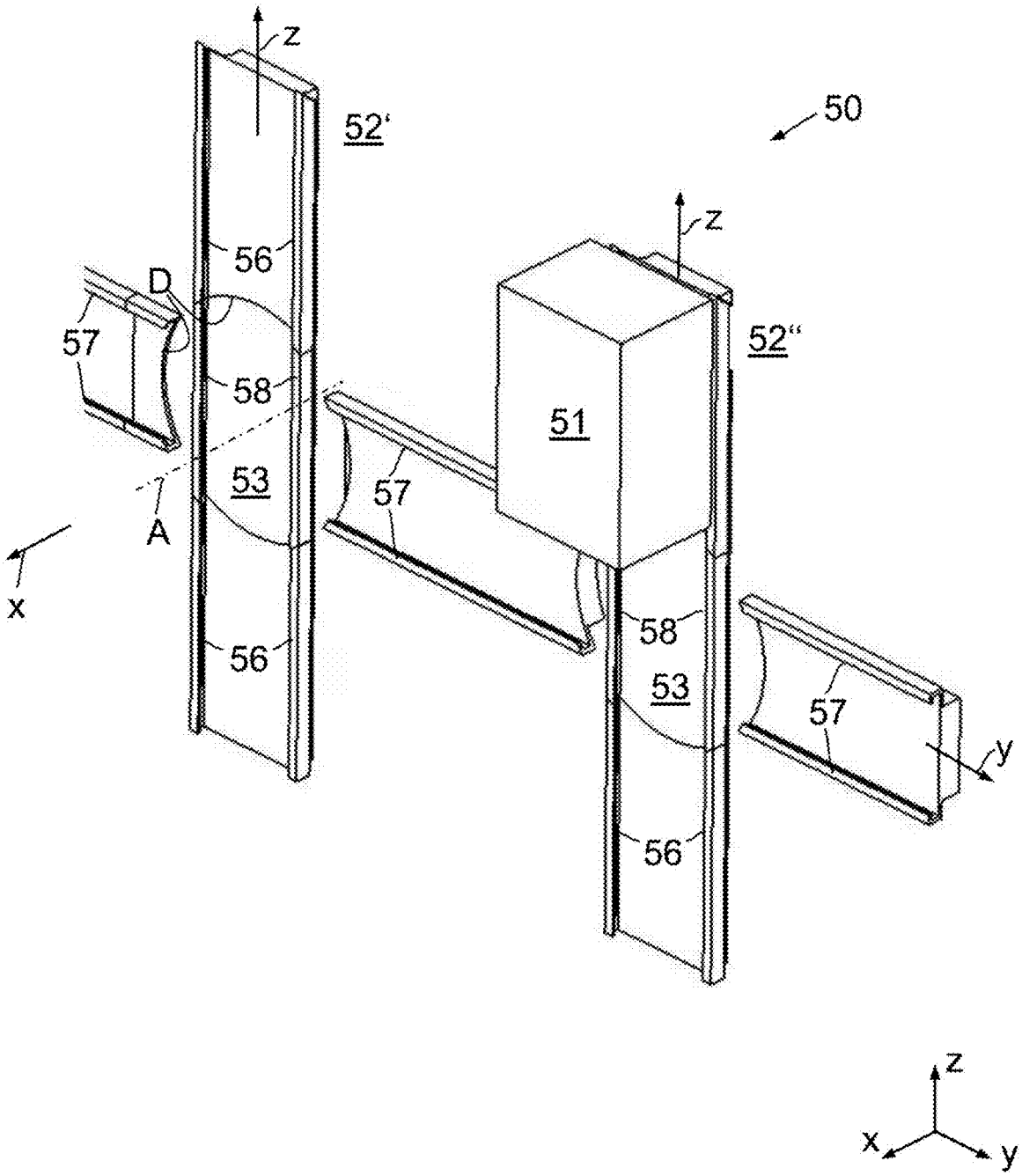
FIG. 1 is diagram of the basic structure of an exemplary elevator installation.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The invention relates to a support device for supporting a platform of an elevator installation.

The support device according to the invention serves to support a platform, in particular a rotary platform, of an elevator installation. The elevator installation comprises at least one elevator car, which can be moved in a shaft by means of guide rails, at least one fixed first guide rail, which is arranged fixedly in a shaft and is aligned in a first, in particular vertical direction and at least one fixed second guide rail, which is arranged fixedly in a shaft and is aligned in particular in a second, in particular horizontal direction. Furthermore, the elevator installation comprises at least one, in particular rotatable, third guide rail mobile with respect to the shaft, which is fastened to the platform and can be transferred between a first position, in particular an alignment in the first direction, and a second position, in particular an alignment in the second direction.

The support device arranged in the elevator installation comprises at least one first form-fit engagement means at one end of the at least one fixed first guide rail, said end facing the platform, and at least one third form-fit engagement means at at least one end of the third guide rail fastened to the platform and rotatable with the latter. In a first platform position, the at least one first form-fit engagement means and the at least one third form-fit engagement means are arranged with respect to one another such that, in the case of a deflection of the platform, in particular around an axis arranged in the second direction, the at least one third form-fit engagement means can be supported on the at least one first form-fit engagement means.

In the case of a deflection of the platform especially around an axis arranged in the second direction, the at least one third form-fit engagement means can be supported on the at least one first form-fit engagement means. A suitable form-fit engagement means is thereby arranged on the end and there, in particular in the region of the end face of the respective guide rail. Such a form-fit engagement means usually comprises a shaped element such as a projection, a groove or a recess, which in the longitudinal direction of the guide rail has a certain overlap with a form-fit engagement means at the end of the guide rail lying opposite. The two engagement means lying opposite one another in the longitudinal direction of the rails are in particular also thus spaced apart from one another perpendicular to the longitudinal direction of the guide rails, in order to enable a movement of the platform, in particular a rotation of the rotary platform. The respective first, second and third guide rail of an elevator installation according to the invention can in each case comprise a plurality of rail elements arranged parallel to one another. In the same way, however, a design of elevator installations according to the invention is also possible, wherein the first, second and third guide rails comprise only one rail element.

In the case of a deflection of the platform in the context of the usual loading during operation of the elevator installation, the engagement means spaced apart from one another do not make contact with one another, in the case of a more marked deflection of the platform in particular accompanying a special event, the form-fit engagement means lying opposite one another come into contact and lie against one another. With the provided support device, the third form-fit engagement means is supported on the opposite first engagement means and further deflection especially of the third guide rail is limited. The term "form-fit" or "form-fitting" is to be understood in the present case such that the corresponding surfaces of the engagement means cooperating in a form-fit manner and thus supported on one another are essentially perpendicular to the direction of the force to be supported and therefore a direct force flux occurs from one form-fit engagement means to the supported form-fit engagement means, so that the support effect results.

In the main claim, a deflection of the platform around an axis arranged in particular in the second direction is specified. In the case of a deflection around such an axis, which represents the most probable case of a deflection with a special event, the weight of the elevator car in particular also acts, so that the upper end of the third guide rail is displaced with respect to the (lower) end of the first guide rail, arranged above the rotary chassis, in the direction towards the elevator car and therefore away from the shaft wall. The opposite lower end region of the third guide rail is displaced with respect to the (upper) end of the first guide rail, arranged below the platform, in the direction away from the elevator car and are therefore towards the shaft wall. Other deflections such as in another direction around an axis arranged in the second direction or deflections around axes arranged differently or translational deflections are conceivable and also included in the main claim, wherein the entire platform is displaced for example perpendicular to the second axis away from the shaft wall or towards the shaft wall or also at an angle.

As a result of the fact that a third form-fit engagement means is arranged at one end, in particular in the region of the end face, of a third guide rail, its support on a first guide rail can be used for a maximum leverage length for the support, which has a favourable effect on the force ratios transmitted via the engagement means.

In an embodiment of the support device, a gap arranged in a third, in particular horizontal, direction essentially perpendicular to the first and second direction is formed between the at least one first form-fit engagement means and the at least one third form-fit engagement means, the extension of which gap, when the platform is not deflected, corresponds to a predetermined maximum misalignment of the third guide rail with respect to the first guide rail in the third direction.

The predetermined maximum misalignment is in particular the misalignment which can just still be tolerated in order to prevent damage to the guide rollers and chassis and, in particular when the safety gear is deployed, damage to an in particular applied brake. The gap basically enables mobility, in particular rotational mobility, of the platform for the transfer of the third guide rail from the first position into the second position or vice versa. The maximum misalignment determines the maximum extension of a gap between the first and the third engagement means. If this gap is closed by the deflection of an in particular third guide rail, the end of the one guide rail projects outwards in the direction of the deflection correspondingly beyond the end of the guide rail adjoining the latter. The resultant maximum misalignment thus corresponds to the gap provided between the form-fit engagement means, which gap predetermines the deflection at which the two form-fit engagement means come into contact and one guide rail is supported on the other guide rail.

In an embodiment of the support device, at least one first form-fit engagement means is arranged in each case at at least one end, facing the platform, of at least one fixed first guide rail arranged above the platform and at least one arranged below the platform. At least one third form-fit engagement means is arranged at the respective corresponding ends of the rotatable third guide rail. In this way, the platform, in the case of a deflection of the platform in particular around an axis arranged in the second direction, can be supported on the third form-fit engagement means arranged at the two ends, on at least one form-fit engagement means arranged above the platform and at least one arranged below the platform.

With this design, the platform is supported at both ends of at least one third guide rail arranged on the platform. Since the leverage ratios of the support of the third guide rail via the third form-fit engagement means at its ends are favourable, a particularly rigid arrangement is possible for limiting the misalignments.

In an embodiment of the support device, at least one second form-fit engagement means is arranged at an end of the at least one fixed second guide rail, said end facing the platform. In the event of an alignment of the platform in the second direction, the at least one second form-fit engagement means and the at least one third form-fit engagement means are arranged with respect to one another such that, in the case of a deflection of the platform in particular around an axis arranged in the first direction, the at least one third form-fit engagement means can be supported on the at least one second form-fit engagement means.

Corresponding to the design at at least one end of a fixed first guide rail, said end facing the platform, a suitable form-fit second engagement means is also arranged at at least one end of a fixed second guide rail, said end facing the platform, and there also in particular in the region of the end face. Accordingly, such a form-fit engagement means usually comprises a shaped element with a projection, a groove or a recess, which in the longitudinal direction of the guide rails has a certain overlap with a form-fit engagement means at the end of the third guide rail lying opposite. The two engagement means lying opposite one another in the longitudinal direction of the guide rails are spaced apart from one another in order to enable rotation of the platform.

In this embodiment of the support device, the at least one second form-fit engagement means can be supported on the at least one third form-fit engagement means in the case of a deflection of the platform in particular around an axis arranged in the first direction. Since a deflection of the platform around an axis arranged in the first direction possibly differs, with respect to a possible misalignment of the guide rails, from a deflection around an axis arranged in the second direction, or the platform can be elastically deformed or displaced differently with respect to the intended position in the horizontal and vertical direction on account of different designs, a different design of the second form-fit engagement means on the second fixed guide rail with respect to the first form-fit engagement means on the first fixed guide rail may also be expedient. Due to the arrangement of the second form-fit engagement means corresponding to the first form-fit engagement means at the end of the second fixed guide rail, a maximum leverage length can also be used for supporting the third guide rail on the second guide rail.

In an embodiment of the support device, a gap arranged in a third, in particular horizontal, direction essentially perpendicular to the first and second direction, is formed between the at least one second form-fit engagement means and the at least one third form-fit engagement means, the extension of which gap, when the platform is not deflected, corresponds to a predetermined maximum misalignment of the third guide rail with respect to the second guide rail in the third direction.

In the same way as with the design of the support device between the first and third guide rail, the predetermined maximum misalignment between the second and third guide rail is in particular the misalignment that can just still be tolerated, at which damage to the guide rollers and the chassis can be avoided. Similarly, the gap enables mobility of the platform. The maximum extension of a gap between the second and third form-fit engagement means is determined from the maximum possible misalignment. If this gap is closed, in particular due to a deflection of the platform or a deformation of the fixed guide rail, the end of a guide rail projects outwards in the direction of the deflection or deformation correspondingly beyond the end of the guide rail adjoining the latter. The resultant maximum misalignment thus corresponds to the provided gap, which predetermines what deflection is required until the form-fit engagement means make contact and therefore one guide rail is supported on the other guide rail. The gap which is provided between the second and third form-fit engagement means can differ from the gap and therefore from the maximum misalignment which can be tolerated between the first and third form-fit engagement means.

In an embodiment of the support device, at least one second form-fit engagement means is arranged in each case on at least one end, facing the platform, of at least one fixed second guide rail arranged in the second, in particular horizontal, direction to the left of the platform and at least one arranged to the right of the platform. Furthermore, at least one third form-fit engagement means is arranged on the respectively corresponding ends of the rotatable third guide rail, so that the platform, in the case of a deflection of the platform in particular around an axis arranged in the first direction, can be supported on the third form-fit engagement means arranged at the two ends, on at least one second form-fit engagement means arranged to the left of the platform and at least one arranged to the right of the platform.

In this design, the platform in the horizontal alignment is supported on both ends of at least one third guide rail arranged on the platform, as a result of which a particularly rigid arrangement for limiting misalignments is possible.

In an embodiment of the support device, the at least one third form-fit engagement means arranged on the third guide rail is designed such that, in a first position, the platform can be supported on at least one first form-fit engagement means arranged on a first guide rail and, in a second position, the platform can be supported on at least one second form-fit engagement means arranged on a second guide rail. In this way, a simple design of a support device is possible, with which both deflections at the junction between the first and third guide rail and also at the junction between the second and third guide rail can be supported.

In an embodiment of the support device, at least one first and/or at least one second and at least one third engagement means is designed such that a misalignment of the respective end of the at least one third guide rail with respect to the corresponding end of at least one first and/or second guide rail can be supported in a direction of an axis which is essentially arranged in the third direction. Such a support device is expedient at such junctions between guide rails in the elevator installation, with which the risk of a deflection of a third guide rail with respect to a fixed guide rail exists in only one direction along the third direction.

If, for example, there is the risk of a deflection of the third guide rail with respect to a first or second, or both fixed guide rails in both directions along an axis arranged in the third direction, the support device is advantageously designed according to an embodiment, in which at least one first and/or at least one second and at least one third engagement means is designed such that a misalignment of the respective end of the at least one third guide rail with respect to the corresponding end of at least one first and/or second guide rail can be supported in both directions of an axis which is arranged essentially in the third direction.

Accordingly, the mutually opposite engagement means of the third and first and/or the third and second guide rails are designed such that, in the case of a support required in only one direction, two projections formed at the ends of the guide rails for example lie opposite one another. If a support in both directions along an axis arranged in the third direction is required, a support device, which is suitable for supporting a guide rail in both directions, thus comprises for example at one end of a guide rail a groove and at the end of the guide rail lying opposite the groove a projection arranged in the groove. Due to the overlapping of the groove and the recess in the longitudinal direction of the rails, the projection is designed so that it can be supported in both directions in the groove.

In an embodiment of the support device, at least one third form-fit engagement means is designed at one end of the rotatable third guide rail differently from the at least one third form-fit engagement means at the other end of the third guide rail. Such an embodiment can be expedient especially when, in the case of a deflection of the platform, the two ends of a third guide rail arranged thereon move in each case in another direction with respect to the first or second guide rails adjoining the latter and are designed so that they can correspondingly be supported thereon in a different direction. Another expedient use of this application is present for example when, especially in design terms, a different deflection of the two ends of a third guide rail is to be expected, so that for example different misalignments occur at the ends and also different deflection forces act on account of the different leverage ratios.

In an embodiment of the support device, the at least one form-fit engagement means comprises a shaped element such as a projection, a groove or a recess, which in the longitudinal direction of the guide rail has a certain overlap with a form-fit engagement means at the end of the guide rail lying opposite. In particular, the stated variants enable a reliable, simple and cost-effective design of the support device.

Depending on the embodiment and the intended use, it is possible to design a form-fit engagement means in one piece (integral) with a guide rail or also in several pieces with a guide rail. An engagement means designed in several pieces with the guide rail can be arranged, for example by means of screwing or another suitable fixing such as riveting or suchlike, also cooperating for example with a form-fit at in particular one end of a guide rail. It is essential that forces can be transferred to the guide rail via the form-fit engagement means.

In an embodiment of the support device, at least one bevel is arranged at at least one end of the at least one fixed first guide rail, which bevel is aligned in the second, in particular horizontal direction. Such a bevel, which in particular is arranged in the running surface of the guide rollers, reduces a gap between two guide rail sections arising due to elastic deformations, so that the crossing-over of the chassis at such a point, at which for example a first guide rail goes over into a third guide rail, has a lesser effect on the travel comfort and reduces wear or damage to the rollers and brakes.

In an embodiment of the support device, at least one bevel is arranged at at least one end of the at least one fixed second guide rail, which bevel is aligned in the first, in particular vertical direction. In the same way as the aforementioned bevel, this bevel, which is also arranged in particular in the running surface of guide rollers, also serves reduce a possible gap between two guide rail sections, so that crossing-over of such a point by the chassis has a lesser effect for the travel comfort and reduces the wear or damage to rollers and brakes.

In an embodiment of the support device, at least one bevel is arranged at at least one end of the third guide rail fastened to the platform and rotatable with the latter, which bevel in an alignment of the guide rail in the first, in particular vertical direction is aligned in the second direction (y), and in an alignment of the guide rail in the second, in particular horizontal direction is aligned in the first direction. This embodiment also enables the advantages of the two aforementioned embodiments. Especially in a combination with at least one of the aforementioned embodiments, bevels are arranged at both mutually opposite ends of the guide rails, so that the advantages during crossing over of the junction between the guide rails are added.

In particular, as will become clear in the example of embodiment, the term "rail" is to be understood in a broad sense and comprises, apart from the regions bearing the running surfaces, also rear regions of the rail which serve for the stability of the rail. The engagement means do not therefore have to be arranged directly on the regions of the rails which provide the running surface, but can if appropriate also be arranged on separate support structures of the rails fastened thereto.

To solve the problem, an elevator installation is also proposed which comprises a support device designed corresponding to the preceding description and in particular a platform by means of which the support device can be supported.

FIG. 1 shows a diagrammatic representation of parts of an exemplary elevator installation 50 according to the invention. Elevator installation 50 comprises fixed first guide rails 56, along which an elevator car 51 can be moved by means of a rucksack bearing. First guide rails 56 are aligned vertically in a first direction z and make it possible for elevator car 51 to be able to move between different storeys. Arrangements of such first guide rails 56, along which elevator car 51 can be guided by means of a rucksack bearing, are arranged parallel to one another in two shafts 52', 52" running in parallel. Elevator cars in the one shaft 52' can move largely independently of and unhindered by elevator cars in the other shaft 52" over respective first guide rails 56.

Elevator installation 50 further comprises fixed second guide rails 57, along which elevator car 51 can be guided with the aid of the rucksack bearing. Second guide rails 57 are aligned horizontally in a second direction y, and make it possible for elevator car 51 to be able to move within a storey. Furthermore, two guide rails 57 connect first guide rails 56 of two shafts 52', 52" to one another. Second guide rails 58 thus also serve for the transfer of elevator car 51 between the two shafts 52', 52", in order for example to implement a modern paternoster operation.

By means of third, rotatable rails 58, elevator car 51 can be transferred from first guide rails 56 to second guide rails 57 and vice versa. Third guide rails 58 are rotatable with respect to a rotation axis A, which lies perpendicular to a y-z plane, which extends through first and second guide rails 56, 57.

All guide rails 56, 57, 58 are fastened at least indirectly to at least one shaft wall 52*a* of shaft 52. The shaft wall defines a fixed reference system of the shaft. The term shaft wall alternatively also includes a fixed frame structure of the shaft, which carries the guide rails. Rotatable third guide rails 58 are fastened to a rotary platform 53.

Such installations are described fundamentally according to WO 2015/144781 A1 and also in German patent applications 10 2016 211 997.4 and 10 2015 218 025.5. In patent application 10 2016 205 794.4, an arrangement with an integrated platform swivel bearing and a drive unit for rotating the rotary platform is described in detail in this connection, which can also be used within the scope of the present invention for the bearing of and as a rotary drive for the rotary platform.

Figure 2A:
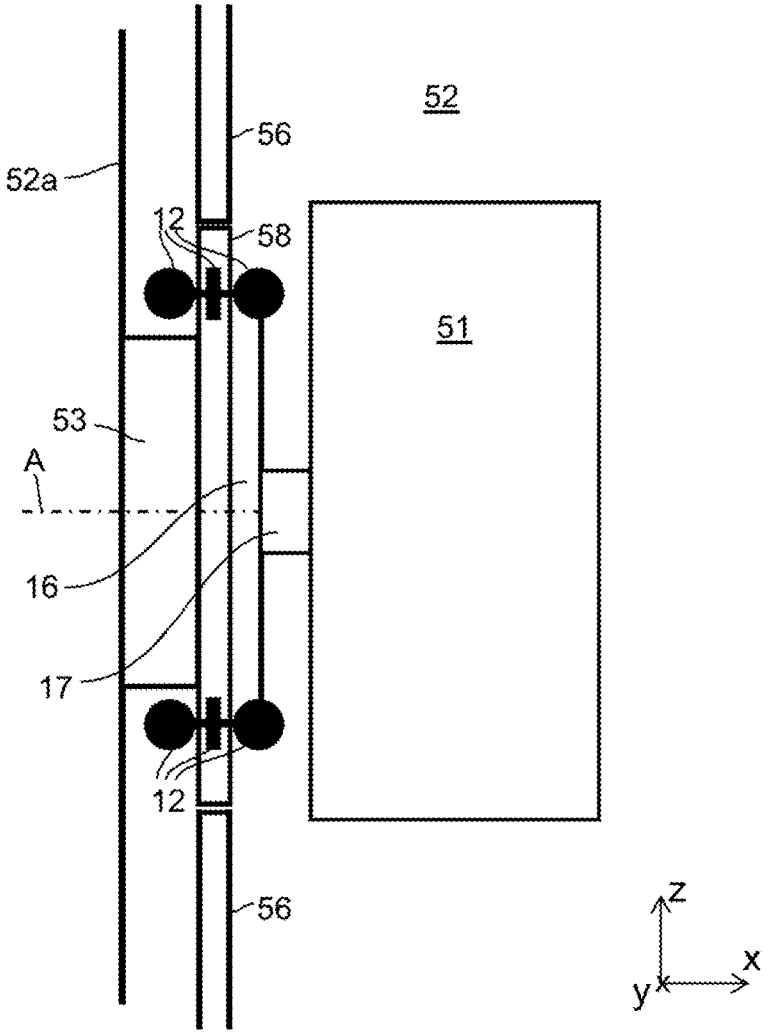
FIG. 2*a* is a diagram of an exemplary arrangement for the transfer of an elevator car from a first elevator shaft into a second elevator shaft.

FIG. 2*a* shows diagrammatically an exemplary arrangement for the transfer of an elevator car 51 from a first elevator shaft into a second elevator shaft in an elevator installation 1 according to the invention. Elevator installation 1 comprises a plurality of elevator cars 51, whereof only one is shown here. Elevator cars 51 can be moved in a plurality of elevator shafts 52.

During the vertical movement, elevator car 51 is guided by means of fixed first guide rails 56. A first guide rail 56 is rigidly fastened to a shaft wall 52*a* of elevator shaft 52. Furthermore, the elevator installation comprises rotatable third guide rails 58. The latter are shown in FIG. 2 in a vertical alignment. Guide rollers 12 roll on guide rails 56, 58. Guide rollers 12 are fastened to a chassis 16, which comprises a drive unit and can move along rails 56, 58. By means of a swivel joint 17, elevator car 51 is fastened to chassis 16. Swivel joint 17 provides for a largely fixed connection between elevator car 51 and chassis 16; only rotatability is provided so as to continue to leave elevator car 51 in its original rotational position during the rotation of chassis 16 in the transfer process.

Rotatable third guide rails 58 are rotatable between the represented vertical alignment and a horizontal alignment. Elevator car 51 is guided by means of a rucksack suspension on guide rails 56, 57, 58. This means that guide rails 56, 57, 58 are all arranged on a common side of the elevator car. This is necessary in order that first guide rails 56, during the horizontal transfer of the elevator car, do not block its horizontal travel path.

Figure 2B:
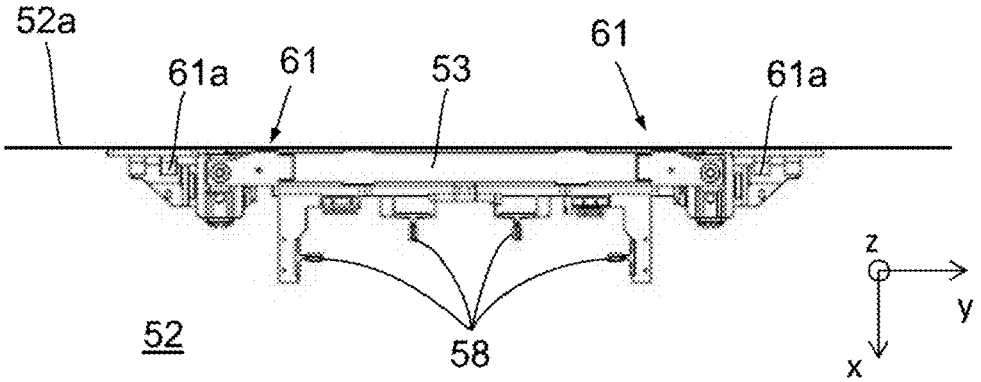
FIG. 2*b* is an above view of the fastening of the rotatable third guide rail on the shaft wall.

FIG. 2*a* shows the fastening of rotatable third guide rail 58 by means of a rotary platform 53 with respect to shaft wall 52*a*. As is represented in FIG. 2*b*, rotary platform 53 is held by a suspension 61, which is arranged fixed to shaft wall 52*a*. Rotary platform 53 is mounted rotatably within suspension 61. Arranged on rotary platform 53 is an exemplary rotatable third guide rail 58, on which guide rollers 12 roll when chassis 16 with elevator car 51 travels over guide rail 58. As can clearly be seen in FIG. 2*b*, guide rail 58 comprises four rail elements, two of which are arranged perpendicular to one another in each case, in order to absorb the forces acting during the travel of elevator car 51.

FIG. 2*b* shows the fastening of rotatable third guide rail 58 by means of a rotary platform 53 with respect to shaft wall 52*a*. As represented in FIG. 2*b*, rotary platform 53 is held by a suspension 61, which is arranged fixed to shaft wall 52*a*. Rotary platform 53 is mounted rotatably within suspension 61. Arranged on rotary platform 53 is an exemplary rotatable third guide rail 58, on which guide rollers 12 roll when chassis 16 with elevator car 51 travels over guide rail 58. As can clearly be seen in FIG. 2*b*, guide rail 58 comprises four rail elements, two of which are arranged perpendicular to one another in each case, in order to absorb the forces acting during the travel of elevator car 51.

Figure 3:
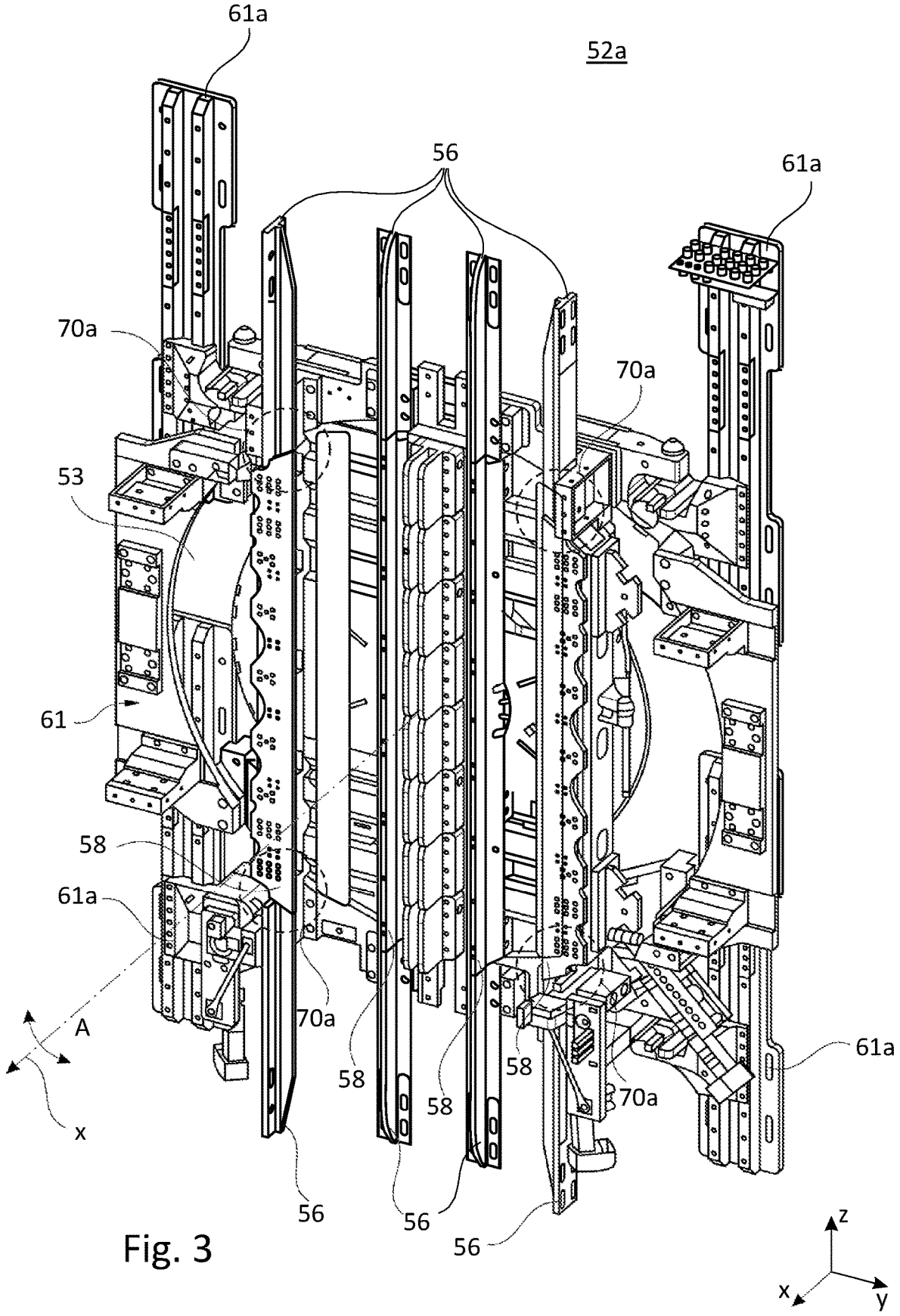
FIG. 3 is a front view of the fastening of the rotatable third guide rail on the shaft wall from the front with the arrangement of the exemplary support device.

FIG. 3 shows a three-dimensional representation of an exemplary embodiment of the fastening of rotatable third guide rail 58 to shaft wall 52*a* from the front. As is already shown in FIG. 2*b*, rotary platform 53 is held by a suspension 61, which is fastened to shaft wall 52*a*. Suspension 61 comprises at the four corners holding fixtures 61*a* arranged on the outside, which are fixedly connected to shaft wall 52*a*. It can clearly be seen in FIG. 3 that rotary platform 53 is designed as circular and rotatable, in order to transfer rotatable third guide rail 58 between the alignment shown in FIG. 3 in the first direction z into an alignment in the second direction y. The rotary platform can rotate both in the clockwise direction and also in the anticlockwise direction around rotation axis A, which lies perpendicular to the y-z plane.

Apart from rotatable third guide rail 58, fixed first guide rails 56 arranged above the rotary platform S3 and below the rotary platform 53 are also represented. The positions of the elements of the exemplary embodiment of support device 70 are marked in FIG. 3 in each case with a circular marking 70*a*. These are arranged at four ends of third rotatable guide rail 58 and respectively at four ends of first fixed guide rails 56 arranged opposite the latter.

Figure 4:
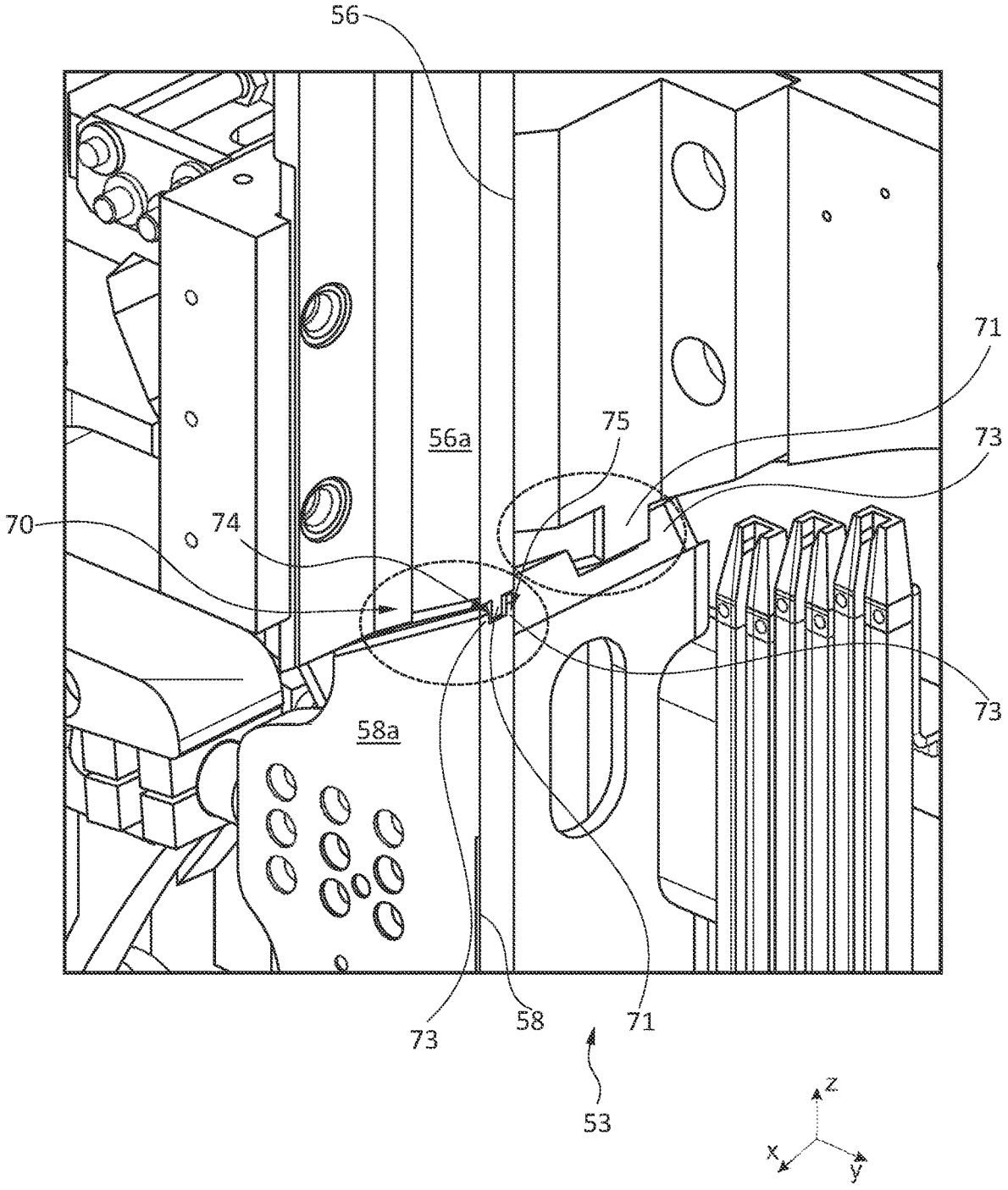
FIG. 4 is a detailed view of an exemplary embodiment of the support device.

FIG. 4 shows an exemplary embodiment of support device 70 in detail. The section shown in FIG. 4 corresponds to the detail marked in FIG. 3 in the circle of marking 70*a* arranged at the top left. In the representation, an end of third rotatable guide rail 58 is shown, which is arranged opposite an end of a first fixed guide rail 56.

As is also shown in FIG. 4, shown exemplary support device 70 comprises two first form-fit engagement means 71 at one end of the at least one fixed first guide rail 56, said end facing rotary platform 53. Furthermore, support device 70 comprises two third form-fit engagement means 73 at one end of a rail element of third guide rail 58 fastened to rotary platform 53 and rotatable with the latter. Both a projection 71 and also a recess or groove 73 are denoted in each case as a form-fit engagement means, even when the latter comprise two contact surfaces arranged in opposite directions and can thus support a misalignment in two directions.

As can clearly be seen, form-fit engagement means 71, 73 are designed such that a rotation of rotary platform 53 around rotation axis A is possible. In the event of an alignment of rotary platform 53 in the first direction z shown in FIG. 4, the two first form-fit engagement means 71 and third form-fit engagement means 73 are arranged with respect to one another in such a way that, in the case of a deflection of rotary platform 53 in particular around an axis arranged in the second direction y, third form-fit engagement means 73 can be supported on first form-fit engagement means 71.

In the detail of exemplary support device 70 represented in FIG. 4, first and third form-fit engagement means 71, 73 are arranged at the ends of the rail elements of fixed first guide rail 56 and of rotatable third guide rail 58, by means of which engagement means a deflection of third rotatable guide rail 58 can be supported in both directions of an axis arranged in the x direction. In the same way, embodiments are also possible in which first and third form-fit engagement means 71, 73 are designed such that the latter can be supported only in the case of a misalignment in an x direction, as is shown for example with the element of support device 70 represented on the right in FIG. 4. Here, only a misalignment of guide rail 58 or of rotary element 53 in a direction x away from the shaft wall 52*a* can be supported.

As can be seen in FIG. 4, a first and a third form-fit engagement means 71, 73 are arranged adjacent to a guide surface 56*a*, 58*a* of guide rails 56, 58, on which guide rollers 12 roll. A gap 74 is formed between first form-fit engagement means 71 arranged there and third form-fit engagement means 73 arranged there, the extension of which gap, in the case of rotary platform 53 not deflected in FIG. 4, corresponds to a predetermined maximum misalignment of third guide rail 58 with respect to first guide rail 56 in third direction x. A second gap 75, which is arranged on the other side of first form-fit engagement means 71, has roughly the same extension as that of gap 74. A misalignment of guide surfaces 56*a*, 58*a* which is greater than respective gaps 74, 75 in the case of a deflection of rotary platform 53 is thus prevented in both x directions.

Figure 5A:
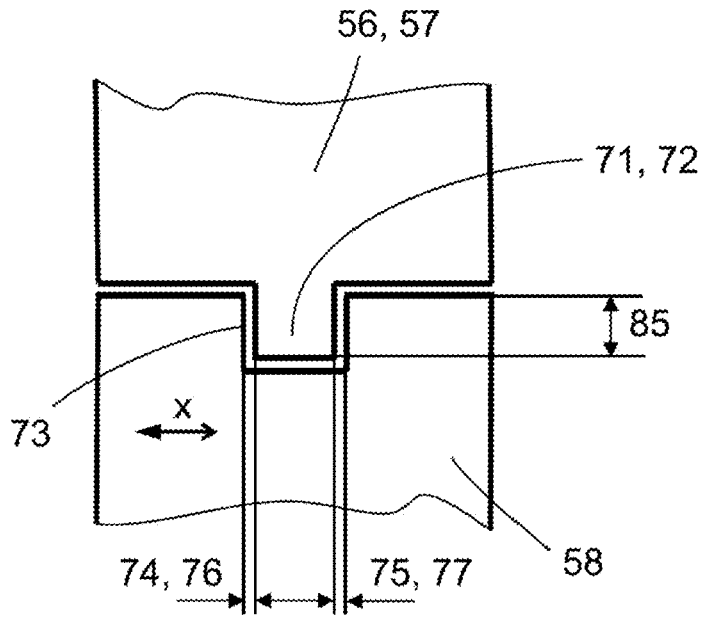
FIG. 5*a* is a detailed diagram of the exemplary support device 70 represented in FIG. 4.

FIG. 5*a* represents diagrammatically a detail of the section of exemplary support device 70 represented in FIG. 4. A first form-fit engagement means 71 in the form of a projection is arranged on second guide rail 56 and a third form-fit engagement means 73 in the form of a recess 73 is arranged on third guide rail 58. First form-fit engagement means 71 and third form-fit engagement means 73 overlap one another with an overlap 85, which also defines a dimension of the support surface required for the support between engagement means 71 and 73.

It can clearly be seen in FIG. 5*a* that a gap 74 is formed between first form-fit engagement means 71 and third form-fit engagement means 73, the extension of which gap corresponds to the maximum misalignment of third guide rail 58 with respect to first guide rail 56 in third direction x. A second gap 75, which has roughly the same extension as that of gap 74, is arranged on the other side of projection 71. Insofar as exemplary support device 70 also comprises a support of rotary platform 53 with respect to second fixed guide rails 57, the support can be designed between second and third guide rails 57 and 58 analogous to the support between first and third guide rails 56 and 58. The extension of a gap 76 formed between second form-fit engagement means 72 and third form-fit engagement means 73 corresponds to the maximum misalignment of third guide rail 58 with respect to second guide rail 57 in third direction x. A second gap 77, which has roughly the same extension as that of gap 76, is arranged on the other side of projection 71. The corresponding reference numbers are entered in FIG. 5*a*.

Figure 5B:
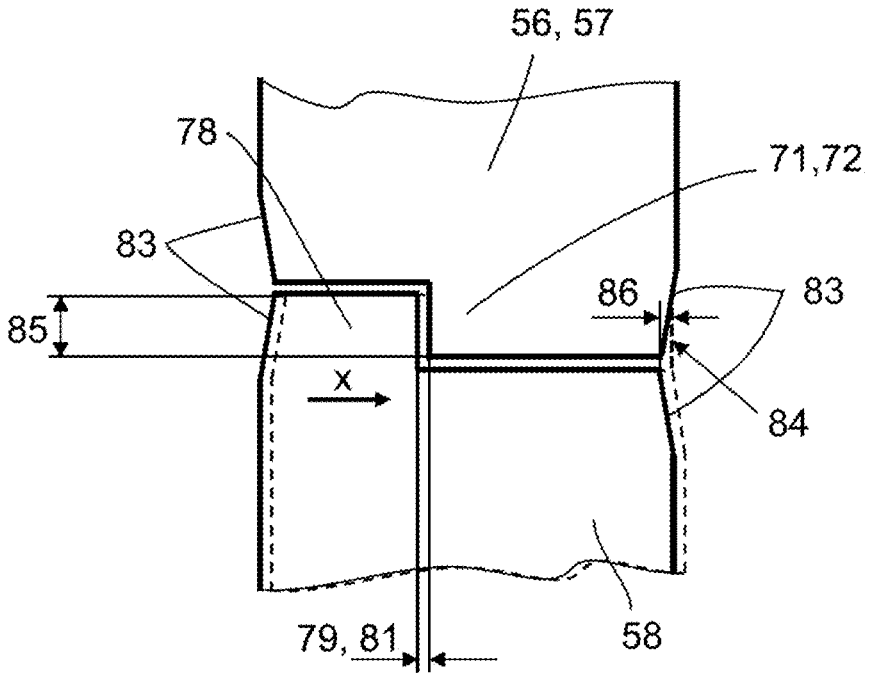
FIG. 5*b* is a further diagram of the embodiment of an exemplary support device 70.

FIG. 5*b* shows a further diagrammatically represented embodiment of a detail of an exemplary support device 70. In this embodiment, a first form-fit engagement means 71 in the form of a projection is also arranged on second guide rail 56, which projection however is formed as step-shaped. A third form-fit engagement means 78 also in the form of a projection formed as step-shaped is formed on third guide rail 58. In this embodiment, a gap 79 is formed between first form-fit engagement means 71 and third form-fit engagement means 78, the extension of which gap corresponds to maximum misalignment 86 of third guide rail 58 with respect to first guide rail 56 in third direction x. A possible misalignment of third guide rail 58 in the opposite direction x with respect to first guide rail 56 cannot be supported in this embodiment. Also in this embodiment of a support device 70, rotary platform 53 can be supported with respect to second fixed guide rails 57, wherein the support can be designed between second and third guide rails 57 and 58 analogous to the support between first and third guide rails 56 and 58. The extension of a gap 81 formed between second form-fit engagement means 72 and third form-fit engagement means 78 corresponds to maximum misalignment 86 of third guide rail 58 with respect to second guide rail 57 in third direction x. The corresponding reference numbers are also entered in this representation.

At least one bevel 83 is provided at the respective ends of first 56 or second 57 guide rail and of third guide rail 58, which bevel is arranged perpendicular to the x-direction. The bevel is arranged in particular on the running surface of guide rollers and improves the crossing-over of junctions between the guide rails. Arrow 84 points to a dashed line, which indicates the transfer between misaligned guide rails that is improved by bevel 83.

In the present example of embodiment, the invention has been described with the aid of a rotatable rotary platform; the invention can for example also be used with a displaceable platform.

LIST OF REFERENCE NUMBERS

12 guide rollers
16 chassis
17 swivel joint
50 elevator installation
51 elevator car
52 shaft
52*a* shaft wall
53 rotary platform
56 fixed vertical first guide rail
57 fixed horizontal second guide rail
58 rotatable third guide rail
61 suspension
61*a* holding fixture
70 support device
70*a* marking
71 first form-fit engagement means
72 second form-fit engagement means
73 third form-fit engagement means
74 gap
75 gap
76 gap
77 gap
78 third form-fit engagement means
79 gap
81 gap
83 bevel
85 overlap
86 misalignment
A rotation axis

What is claimed is:

1. An elevator installation comprising:

a shaft wall;

a plurality of guide rails fastened to said shaft wall;

an elevator car having a plurality of guide rollers affixed thereto that are configured to roll along said plurality of guide rails to permit movement of said elevator car with respect to said shaft wall, said guide rollers further configured to transfer at least a portion of a weight of said elevator car to said guide rails;

a linear drive, separate from said guide rails, that is configured to drive said elevator car along said guide rails via said guide rollers;

a rotary platform fastened to a rotary drive and configured to be rotated by said rotary drive, with respect to said shaft wall, about an axis of rotation perpendicular to said rotary platform;

a fixed first guide rail, from said plurality of guide rails, fastened to said shaft wall adjacent said rotary platform and extending in a first direction, and having at least one first form-fit engagement means disposed at an end thereof facing said platform;

at least one fixed second guide rail, from said plurality of guide rails, fastened to said shaft wall, having an end disposed adjacent said rotary platform, and extending in a second direction; and a third guide rail, from said plurality of guide rails, fastened to said rotary platform and not intersecting the axis of rotation of said rotary platform, said third guide rail having at least one third form-fit engagement means disposed at an end thereof, said third guide rail being rotatable with said rotary platform between a first position in alignment with said first guide rail and a second position in alignment with said second guide rail, wherein said first form-fit engagement means and said third form-fit engagement means are respectively configured such that when said rotary platform is in the first position, said at least one third form-fit engagement means overlaps said at least one first form-fit engagement means in a longitudinal direction of said first guiderail, and when said rotary platform is not in a deflected state, a gap is defined between said first form-fit engagement means and said third form-fit engagement means in a third direction perpendicular to said shaft wall, a width of said gap being equal to a predetermined maximum misalignment distance in the third direction between adjacent ends of said third guide rail and said first guide rail, and when said rotary platform is deflected around an axis extending in the second direction, said third form-fit engagement means deflects in said third direction into contact with, and is supported by, said first form fit engagement means to prevent said third guide rail from deflecting out of alignment with said first guide rail by more than said maximum misalignment distance.

2. The elevator installation of claim 1, wherein the third direction is horizontal.

3. The elevator installation of claim 1, wherein said fixed first guide rail comprises a fixed first guide rail disposed above said platform and a first fixed guiderail disposed below said platform, each having one of said at least one first form-fit engagement means disposed at their respective ends facing said platform, and wherein said rotatable third guide rail has at least one third form-fit engagement means disposed at each opposing end thereof, each of which third form-fit engagement means being configured to support said platform on each of said first form fit engagement means when said platform is deflected around an axis extending in the second direction.

4. The elevator installation of claim 1, wherein said fixed second guide rail comprises a second form-fit engagement means disposed at an end thereof facing said rotary platform, and wherein said second form-fit engagement means and said third form-fit engagement means are respectively configured such that when said rotary platform is in the second position and there is a deflection of said platform around an axis extending in the first direction, said third form-fit engagement means is supported on said second form-fit engagement means.

5. The elevator installation of claim 4, wherein a gap is defined between said second form-fit engagement means and said third form-fit engagement means in the third direction, such that when said rotary platform is not deflected, a width of the gap corresponds to a predetermined maximum misalignment distance in the third direction between said third guide rail and said fixed second guide rail.

6. The elevator installation of claim 1, wherein said at least one fixed second guide rail comprises a first fixed horizontal guiderail disposed to a left side of said rotary platform and a second fixed horizontal guiderail disposed to a right side of said rotary platform, each of said respective first and second horizontal guide rails having a second form-fit engagement means disposed at an end thereof facing said rotary platform, and wherein said rotatable third guide rail has at least one third form-fit engagement means disposed at each opposing end thereof, such that when said rotary platform is in the second position and there is a deflection of said platform around an axis extending in the first direction, said third form-fit engagement means disposed at opposing ends of said rotary platform are supported on at least one of said second form-fit engagement means disposed at respective ends of said first and second horizontal guide rails.

7. The elevator installation of claim 1, wherein said at least one third form-fit engagement means is configured such that, when said rotary platform is rotated to said first position, said third form-fit engagement means can be supported on said at least one first form-fit engagement means, and when said rotary platform is rotated to said second position, said third form-fit engagement means can be supported on said at least one second form-fit engagement means.

8. The elevator installation of claim 1, wherein said fixed second guide rail comprises a second form-fit engagement means disposed at an end thereof facing said rotary platform, and wherein at least one of said first or second form-fit engagement means and at least one of said third form-fit engagement means are configured such that a misalignment of an end of said third guide rail with respect to a corresponding end of at least one of said fixed first guide rail or said fixed second guide rail can be supported in at least one of two opposing axial directions of an axis that is parallel to the third direction.

9. The elevator installation of claim 1, wherein said fixed second guide rail comprises a second form-fit engagement means disposed at an end thereof facing said rotary platform, and wherein at least one of said first or second form-fit engagement means and at least one of said third form-fit engagement means are configured such that a misalignment of an end of said third guide rail with respect to a corresponding end of at least one of said fixed first guide rail or said fixed second guide rail can be supported in both of two opposing axial directions of an axis that is parallel to the third direction.

10. The elevator installation of claim 1, wherein at least one of said third form-fit engagement means is respectively disposed at each of opposing first and second ends of said third guide rail, wherein said third form-fit engagement means disposed at said first end is configured differently from said at least one third form-fit engagement means disposed at said second end.

11. The elevator installation of claim 1, wherein one of said first or third form-fit engagement means comprises one of a projection, a groove, or a recess, and is configured to overlap the other of said first or third form-fit engagement means when said first and third guide rails are respectively aligned with each other.

12. The elevator installation of claim 1, wherein at least one end of said first guide rail is beveled so as to define a beveled face parallel to the second direction.

13. The elevator installation of claim 1, wherein at least one end of said second guide rail is beveled so as to define a beveled face parallel to the first direction.

14. The elevator installation of claim 1, wherein at least one end of said third guide rail is beveled so as to define a beveled face, wherein when said third guiderail is rotated to said first position, said beveled face is positioned parallel to said second direction, and when said third guiderail is rotated to said second position, said beveled face is positioned parallel to said first direction.

15. An elevator installation comprising:

a shaft wall;

a plurality of guide rails fastened to said shaft wall;

an elevator car having a plurality of guide rollers affixed thereto that are configured to roll along said plurality of guide rails to permit movement of said elevator car with respect to said shaft wall, said guide rollers further configured to transfer at least a portion of a weight of said elevator car to said guide rails;

a linear drive, separate from said guide rails, that is configured to drive said elevator car along said guide rails via said guide rollers;

a rotary platform fastened to a rotary drive and configured to be rotated by said rotary drive, with respect to said shaft wall, about an axis of rotation perpendicular to said rotary platform;

a fixed first guide rail, from said plurality of guide rails, fastened to said shaft wall adjacent said rotary platform and extending in a first direction, and having at least one first form-fit engagement means disposed at an end thereof facing said platform;

a fixed second guide rail, from said plurality of guide rails, fastened to said shaft wall, having an end disposed adjacent said rotary platform and extending in a second direction, and having at least one second form-fit engagement means disposed at an end thereof facing said platform; and a third guide rail, from said plurality of guide rails, fastened to said rotary platform and not intersecting the axis of rotation of said rotary platform, said third guide rail being rotatable with said rotary platform between a first position in alignment with said first guide rail and a second position in alignment with said fixed second guide rail, said third guide rail having at least one third form-fit engagement means disposed at an end thereof, with one of said first or third form-fit engagement means comprising one of a projection, a groove, or a recess, wherein said first form-fit engagement means and said third form-fit engagement means are respectively configured such that when said rotary platform is in the first position, said third form-fit engagement means overlaps said first form-fit engagement means in a longitudinal direction of said fixed first guiderail, and when said rotary platform is deflected around an axis extending in the second direction, said third form-fit engagement means deflects in a third direction perpendicular to said shaft wall into contact with, and is supported by, said first form fit engagement means, wherein said second form-fit engagement means and said third form-fit engagement means are respectively configured such that when said rotary platform is in the second position, said third form-fit engagement means overlaps said second form-fit engagement means in a longitudinal direction of said fixed second guiderail, and when said rotary platform is not in a deflected state, a gap is defined between said second form-fit engagement means and said third form-fit engagement means in the third direction, a width of said gap being equal to a predetermined maximum misalignment distance in the third direction between adjacent ends of said third guide rail and said fixed second guide rail, and when said rotary platform is deflected around an axis extending in the first direction, said third form-fit engagement means deflects in said third direction into contact with, and is supported by, said second form fit engagement means to prevent said third guide rail from deflecting out of alignment with said fixed second guide rail by more than said maximum misalignment distance.

* * * * *